United States Patent [19]

Sato et al.

[11] Patent Number: 4,771,956

[45] Date of Patent: Sep. 20, 1988

[54] METHOD OF AND APPARATUS FOR WINDING COIL ON TOROIDAL CORE

[75] Inventors: Hiroshi Sato, Yokohama; Toshijiro Ohashi, Chigasaki; Toyohide Hamada, Yokohama; Yukimori Umakoshi, Odawara; Takamichi Suzuki; Yuuji Wada, both of Yokohama; Shigeo Hara, Minamiashigara; Youshuke Fukumoto, Odawara, all of Japan

[73] Assignee: Hitachi, Ltd., Tokyo, Japan

[21] Appl. No.: 888,430

[22] Filed: Jul. 23, 1986

[30] Foreign Application Priority Data

| | | | |
|---|---|---|---|
| Aug. 2, 1985 | [JP] | Japan | 60-169832 |
| Nov. 22, 1985 | [JP] | Japan | 60-261433 |
| May 21, 1986 | [JP] | Japan | 61-114556 |
| May 29, 1986 | [JP] | Japan | 61-122343 |
| Jul. 4, 1986 | [JP] | Japan | 61-156034 |

[51] Int. Cl.[4] ..... H01F 41/08

[52] U.S. Cl. ..... 242/4 R; 29/605

[58] Field of Search ..... 242/4 R, 7.03, 7.09; 29/605

[56] References Cited

U.S. PATENT DOCUMENTS

| | | | |
|---|---|---|---|
| 3,669,365 | 6/1972 | Loturco | 242/4 B |
| 3,877,652 | 4/1972 | Bernau | 242/4 C |
| 3,985,310 | 10/1976 | Kent et al. | 242/4 R |
| 4,007,881 | 2/1977 | Haslau et al. | 242/4 C |
| 4,127,238 | 11/1978 | Potthoff | 242/4 A |
| 4,269,366 | 5/1981 | Lindenmeyer | 242/4 R |
| 4,424,939 | 10/1984 | Ohaski et al. | 242/4 R |
| 4,491,281 | 1/1985 | Dosaka | 242/4 R |
| 4,529,138 | 7/1985 | Perschka | 242/4 R |
| 4,568,032 | 2/1986 | Ishida et al. | 242/4 R |

*Primary Examiner*—Stuart S. Levy
*Assistant Examiner*—Thomas R. Hannon
*Attorney, Agent, or Firm*—Antonelli, Terry & Wands

[57] ABSTRACT

A method of and an apparatus suitable for use in winding a coil on a toroidal core of a magnetic head of a video tape recorder or magnetic disc player by passing a wire through a minuscule aperture. The apparatus includes an annular wire guide formed with a cutout, a plurality of pairs of feed rollers having axes disposed perpendicular to a plane in which the annular wire guide is disposed, the rollers of each pair engaging each other inside the annular wire guide, and at least one core holding unit for holding a core in such a manner as to be positioned in the cutout of the annular wire guide. By repeatedly performing the operations of feeding a wire by the feed rollers, guiding the movement of the wire by the annular wire guide and inserting the wire through a core window of the toroidal core after transporting the wire to the wire insertion position, it is possible to wind a coil positively with increased speed and reliability.

5 Claims, 18 Drawing Sheets

METHOD OF AND APPARATUS FOR WINDING COIL ON TOROIDAL CORE

BACKGROUND OF THE INVENTION (1) Field of the Invention

This invention relates to a method and apparatus for winding a coil on a toroidal core, and, more particularly, to a method and an apparatus suitable for use in winding a coil on a toroidal core of, for example, a magnetic head of a video tape recorder (VTR) or magnetic disc player, for example, by passing a wire through a minuscule aperture.

(2) Description of the Prior Art

An apparatus for winding a coil on a toroidal core is disclosed in Japanese Patent Unexamined Publication No. 186926/83, wherein a vacuum pipe located beneath a core window is actuated to draw by suction a wire positioned above the core window and pass the same through the core window, and then the vacuum pipe is moved downwardly to withdraw the wire and insert the same in an inlet, located beneath the core window, of an arcuate guide extending in a direction in which the wire is wound or from beneath to above the core window while a compressed air current is directed against the wire through a nozzle located on a side opposite the wire inlet side of the guide, to thereby feed the wire upwardly through the core window and wind the same on the toroidal core.

The problem encountered in this apparatus is that, since the wire is drawn by suction by a vacuum pipe and fed by compressed air while being held by the force of drawn air, difficulty is experienced in ensuring that the wire is positively passed through the core window and also in achieving increased speed of operation.

Another type of apparatus for winding a coil on a toroidal core is disclosed in U.S. Pat. No. 4,529,138 in which a wire is fed along an annular guide by rollers to wind the same on the toroidal core, and a portion of the wire is gripped and pulled by a gripper to achieve a winding of the wire on the toroidal core. This apparatus suffers the disadvantage that the mechanism for winding the wire on the core is complex, thwarting plans to obtain increased speed in operation for winding a wire. Additionally, the apparatus lacks means for avoiding buckling at a leading end portion of the wire and keeping the leading end portion of the wire from entering the inside of the wire guide when the wire has a low stiffness and the core window is small sized.

SUMMARY OF THE INVENTION

This invention has as its object the provision of a method and an apparatus for winding a coil on a toroidal core which enable the production of a toroidal coil to be achieved at high speed and with increased reliability in performance, by repeatedly performing the operation of positively passing the wire through the window of the toroidal core and transporting the leading end portion of the wire to the wire insertion position.

In one aspect of the invention, the apparatus includes annular wire guide means formed with a cutout, feed roller means comprising a plurality of pairs of feed rollers, with the rollers of each pair engaging each other inside the annular wide guide means and having axes located perpendicular to a plane in which the annular wire guide means is located, and at least one core holding unit for holding a core in such a manner that the window of the core is located inside the cutout of the annular wire guide means.

In another aspect of the invention, the apparatus includes feed roller means imparting tension to the wire, means comprising a pad and a pin for controlling the direction in which the wire is tensioned, movable wire guide means located on the wire insertion side of the core window and nozzle means for directing air currents against the wire.

DESCRIPTION OF THE PREFERRED EMBODIMENTS

Figure 1:
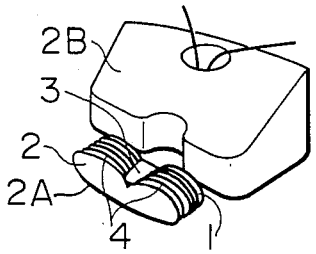
FIG. 1 is a perspective view of one example of the core used with a VTR, for which the invention may be employed.

FIG. 1 shows one example of a core 2, used with a VTR, for which the invention may be employed. The core 2 is a plate-like member formed of ferrite and having a thickness of about 0.4 mm and longitudinal and transverse dimensions of about 2–3 mm. The core 2 comprises a tape sliding surface 2A, a window (referred to hereinafter as a core window) 3 of about 0.3×0.3 mm located in the vicinity of the tape sliding surface 2A and two coil-winding portions 4 each located on one of opposite sides of the core window 3 to have an electric wire (referred to hereinafter as a wire) 1 including a core of about 0.03 mm in diameter wound thereon by passing through the core window 3. The number of turns of the wire 1, which may vary depending on the article to be produced, is usually in the range between five and fifteen on either one of the two coil-winding portions 4. The toroidal core 2 is attached on a forward end of a core base 2B which, in turn, is mounted to an upper cylinder, not shown.

Figure 2:
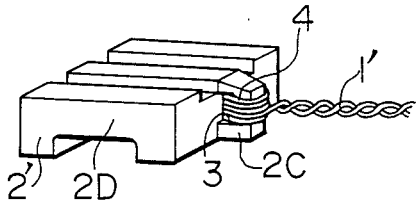
FIG. 2 is a perspective view of another example of the core used with a magnetic disc player, for which the invention may be employed.

FIG. 2 shows one example of a core 21 used with a magnetic disc, for which the invention may be employed. The core 2' also formed of ferrite includes a head 2C having a thickness of about 0.4 mm and longitudinal and transverse dimensions of about 1–2 mm, and a slider portion 2D having a thickness of about 2 mm and longitudinal and transverse dimensions of about 3–5 mm. A core window 3 of about 0.5×0.5 mm is formed in the head 2C of the core 2', and an electric wire 1', including a core of about 0.05 mm in diameter, is wound on the coil-winding portion 4 located on a side of the core window 3 opposite the side thereof at which the slider portion 2D is located. The number of turns of the wire 1', which may vary depending on the article to be produced, is usually in the range between ten and thirty.

Figure 3:
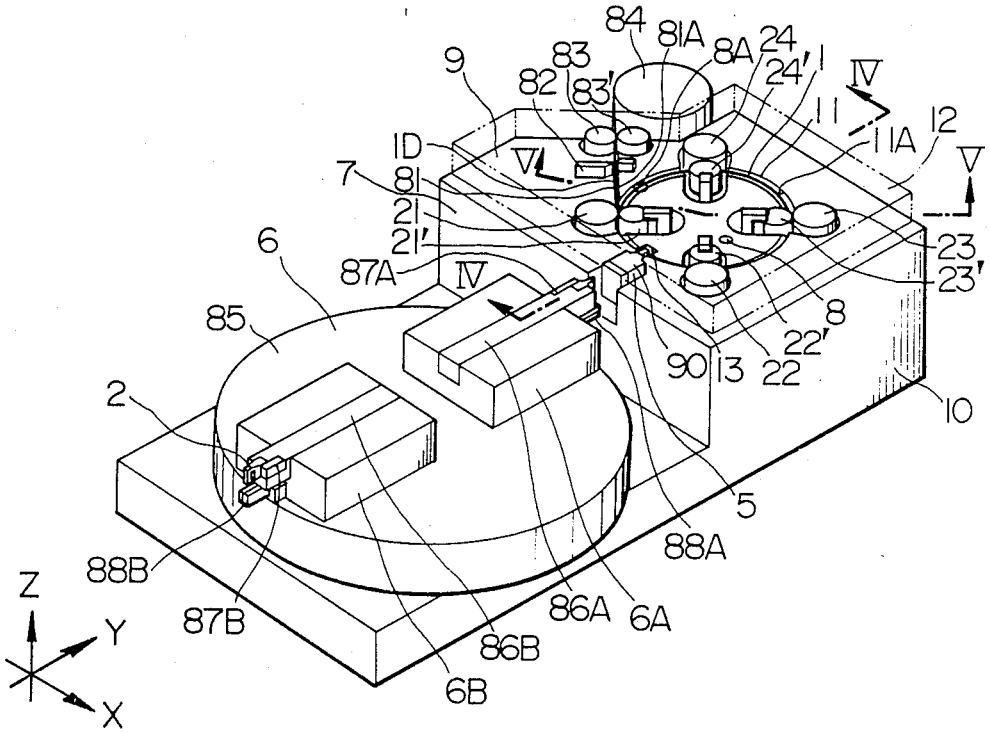
FIG. 3 is a perspective view of a first embodiment of the apparatus for winding a coil according to the invention.

FIG. 3 shows one embodiment of the apparatus for winding a coil on a toroidal core in accordance with the invention, with the apparatus comprising a core feeding and discharging section 6 in which the core 2 is supported on a base 10 for movement in three directions Z, X and Y, a coil winding section 7 for winding the wire 1 on the core 2, a wire feeding section 9 for feeding the wire 1 to the coil winding section 7 and a wire trailing end portion withdrawing section 5 for withdrawing a wire trailing end portion 1D in the Z direction from a core holding position.

Formed in the top surface of the base 10 in the coil winding section 7 is an annular groove 11A which cooperates with a cover 12 to form an annular wire guide 11 formed with a cutout 13. A wire withdrawing rod 90 (or the core 2) is arranged such that opposed side edges of the cutout 13 are disposed on opposite sides of a wire passing hole 90A (or the core window 3 of the core 2) of the wire withdrawing rod 90. A pair of rollers 21 and 21' are located along the annular wire guide 11 in a position located on the wire inlet side of the wire passing hole 90A (or the core window 3). A pair of rollers 22 and 22' are located along the annular wire guide 11 in a position located on the wire outlet side of the wire passing hole 90A (or the core window 3). A pair of rollers 23 and 23' and a pair of rollers 24 and 24' are located along the annular wire guide 11 in positions which are located between the two pairs of rollers 21, 21' and 22, 22'. The rollers 21, 21', 22, 22', 23, 23' and 24, 24' are located such that their axes of rotation are perpendicular to a plane in which the annular wire guide 11 is located, and the point of contact between the rollers of each pair is disposed inside the annular wire guide 11. A sensor 8 for monitoring the passage of the wire 1 is located on an imaginary straight line connecting the core 2 to the roller 23', and another sensor 8A for monitoring the passage of the wire 1 is located on the bottom surface of a portion of the annular groove 11A between the two pairs of rollers 24, 24' and 21 and 21'.

Formed at the top surface of the base 10 in the wire feeding section 9 is an arcuate groove 81A which has as its tangent a common tangent of the rollers 21 and 21'. The groove 81A cooperates with the cover 12 for the groove 11A to constitute an arcuate wire guide 81. A cutter 82 is located along the wire guide 81 in a position spaced apart a predetermined distance from the core 2, and rollers 83 and 83' are located on opposite sides of a portion of the wire guide 81 which is spaced apart from the cutter 82 and core 2. A bobbin 84, supported for rotation relative to the base 10 and located in a position spaced apart from the rollers 83 and 83', cutter 82 and core 2. The rollers 21, 21', 22, 22', 23, 23', 24, 24' and 83, 83' are controlled to rotate at the same peripheral velocity.

Figure 4:
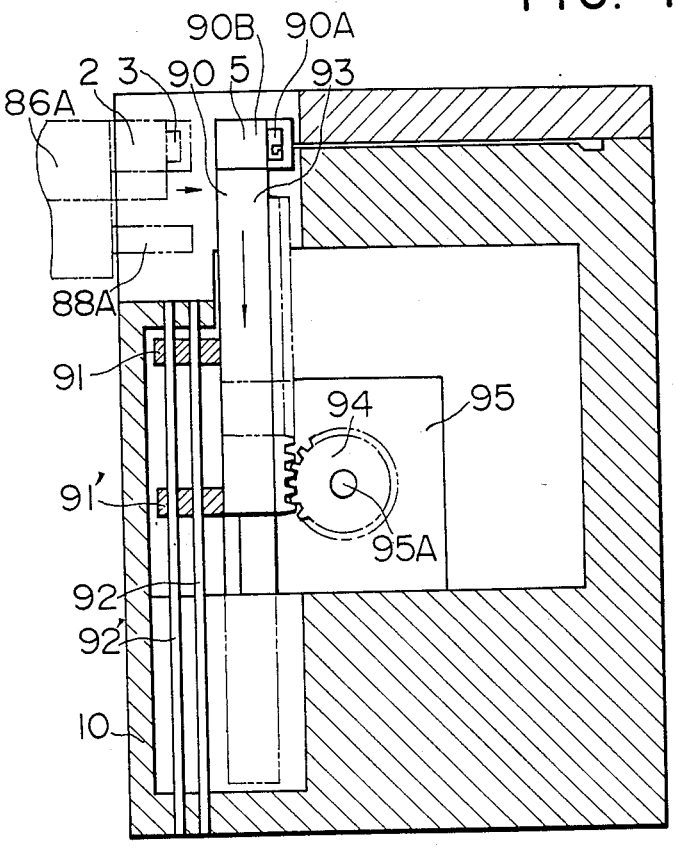
FIG. 4 is a sectional view taken along the line IV—IV in FIG. 3.
Figure 5:
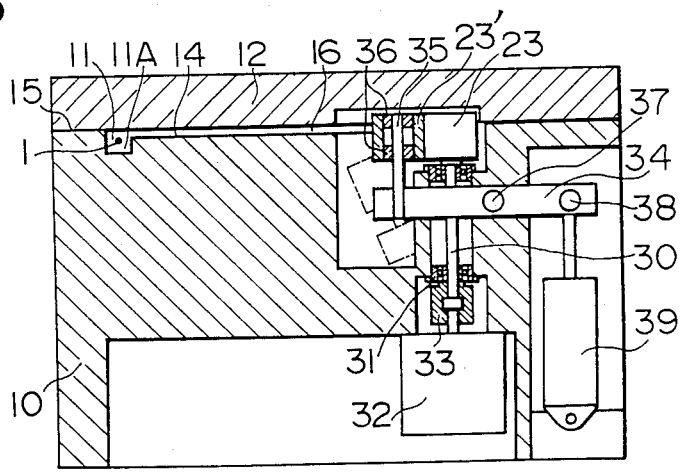
FIG. 5 is a sectional view taken along the line V—V in FIG. 3.

The core feeding and discharging section 6 comprise a turntable 85 supported for rotation relative to the base 10, turntable rotating means, not shown, and two core holding units 6A and 6B disposed on the turntable 85. Each core holding unit 6A (6B) comprises a slider 86A (86B) supported on the turntable 85 for sliding movement in the Y direction, a drive, not shown, for the slider 86A (86B), a core clamper 87A (87B) for clamping the core 2, a gripper 88A (88B) for gripping the trailing end portion 1D and means, not shown, for opening and closing the gripper 88A (88B). As shown in FIG. 4, the wire end portion withdrawing section 5 comprises a wire withdrawing rod 90 configured to have a forward end portion 90B resembling the core 2 and to be formed with a hole 90A in a position corresponding to that of the core window 3, bearings 91 and 91' secured to the wire withdrawing rod 90, guide rails 92 and 92' engaging the bearings 91 and 91' and secured to the base 10, a rack 93 secured to the wire withdrawing rod 90 and a gear 94 engaging the rack 93 and secured to a shaft 95A of a motor 95 secured to the base 10. By rotating the motor 95, it is possible to move the forward end portion 90B of the wire withdrawing rod 90 from a core holding position shown in solid lines in FIG. 4 to a position shown in phantom lines in FIG. 4 in which it does not interfere with the core 2 and gripper 88A when the slider 86A moves forwardly. As shown in FIG. 5, a flat surface portion 14, located inside the annular groove 11A on the base 10, is disposed at an elevation lower than that of a flat surface portion 15 located outside the annular groove 11A by a dimension slightly greater than the diameter of the wire 1. As described previously, the cover 12 is provided for enclosing the annular groove 11A. A portion defined by the groove 11A and cover 12 and a portion formed by a gap defined between the flat surface portion 14 and cover 12 shall be referred to as a wire guide 11 and a slit 16, respectively.

A rotary shaft 30 of the roller 23 is journalled by a bearing 31 for rotation relative to the base 10 and coupled through a coupling 33 to a motor 32 on the base 10. The roller 23' is journalled for rotation by a bearing 36 supported by a shaft 35 secured to a pivotal arm 34 which is pivotally supported by the base 10 and connected to a pneumatic cylinder 39 through a pin 38. By actuating the pneumatic cylinder 39, it is possible to move the pivotal arm 34 in pivoting movement with a pin 37 serving as a fulcrum so as to move the roller 23' from a position in which it is urged against the roller 23 to a position shown in phantom lines in FIG. 5 in which it is lowered away from the flat surface portion 14. The rollers 21, 21', 22, 22' and 24, 24' are similar in construction to the rollers 23, 23'.

One embodiment of the method of winding a coil on a core in accordance with the invention will be described by referring to FIGS. 6–16. FIG. 16 is a timing chart showing the relationship between the various constituent elements.

Figure 6:
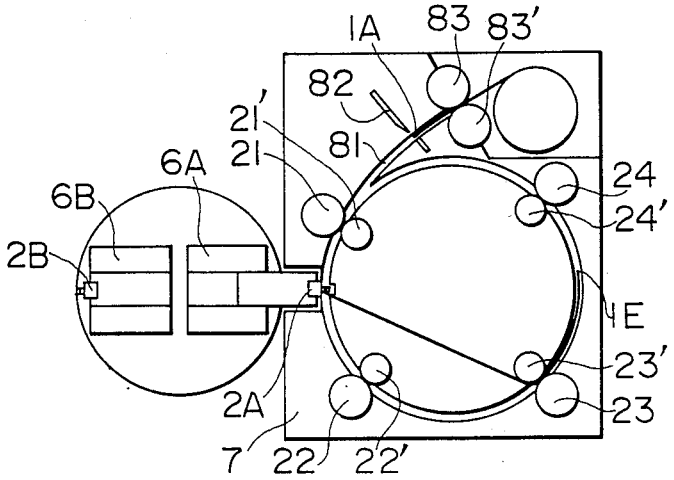
FIGS. 6–11 are views illustrating the steps of feeding a wire and treating an end portion of the wire and the steps of feeding and discharging a core.

FIG. 6 shows the coil winding section 7 and core feeding and discharging section 6 in a position in which coil winding has been finished. A core 2A on which a coil has been wound is held by the core holding unit 6A disposed in the coil winding section 7. A preceding leading end portion 1E of the wire 1 wound on the core 2A is held between the rollers 23 and 23'. Meanwhile another core 2B is held by the core holding unit 6B and disposed in the core feeding and discharging section 6. A succeeding leading end portion 1A of the wire 1, fed from the wire feeding section 9, is held between the rollers 83 and 83' and located in the arcuate wire guide 81. The cutter 82 is in an open position, and the rollers 21', 22', 23' and 24' are forced against the associated rollers 21, 22, 23 and 24 respectively. The wire withdrawing rod 90 is in a lower position.

Figure 7:
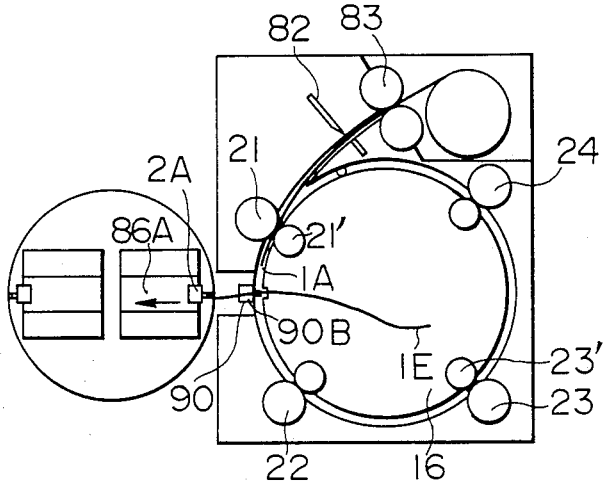

As the slider 86A is moved rearwardly as shown in FIG. 7 from the position shown in FIG. 6, the leading end portion 1E of the wire 1 wound on the core 2A is withdrawn together with the core 2A and released from engagement with the rollers 23, 23' to lie in the slit 16. As the forward end portion 90B of the wire withdrawing rod 90 is moved upwardly to a core holding position simultaneously as the slider 86A is moved rearwardly, the preceding leading end portion 1E of the wire 1 disposed in the core holding position is pushed upwardly by the wire withdrawing rod 90 away from a wire transporting path. Rotation of the rollers 83, 21, 22, 23 and 24 feeds the succeeding leading end portion 1A to a position anterior to the core holding position with respect to the direction of movement of the wire 1.

Figure 8:
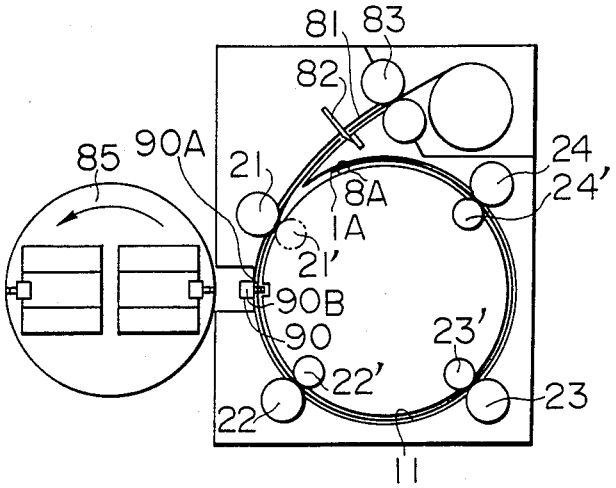

Referring to FIG. 8, the succeeding leading end portion 1A of the wire 1 is further fed by the rollers 21 and 21' from its position shown in FIG. 7 and guided by the annular wire guide 11 in its movement until it passes through the hole 90A in the wire withdrawing rod 90. With the forward end portion 90B of the wire withdrawing rod 90 being similar in configuration to the core 2, the succeeding leading end portion 1A of the wire 1 is able to pass through the hole 90A as is the case with an ordinary coil winding apparatus. The leading end portion 1A of the wire 1 is further fed by the rollers 21, 21', 22, 22', 23, 23' and 24, 24' and guided by the annular wire guide 11 to reach the detector 8A. Upon the leading end portion 1A being sensed by the sensor 8A, the rollers 21, 22, 23, 24 and 83 are caused to stop rotating, the wire 1 is cut by the cutter 82 and the roller 21' is brought out of engagement with the roller 21. The turntable 85 is rotated through 180 degrees.

Figure 9:
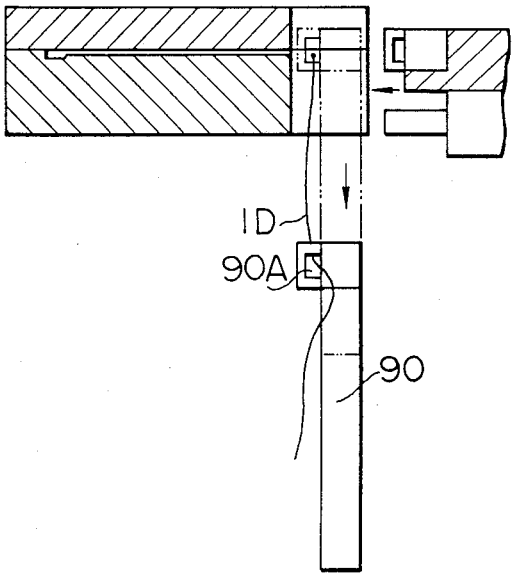

FIG. 9 shows the wire withdrawing rod 90 moved downwardly from its position shown in FIG. 8. Downward movement of the wire withdrawing rod 90 causes the wire trailing end portion 1D inserted in the hole 90A in the rod 90 to be pulled downwardly .

Figure 10:
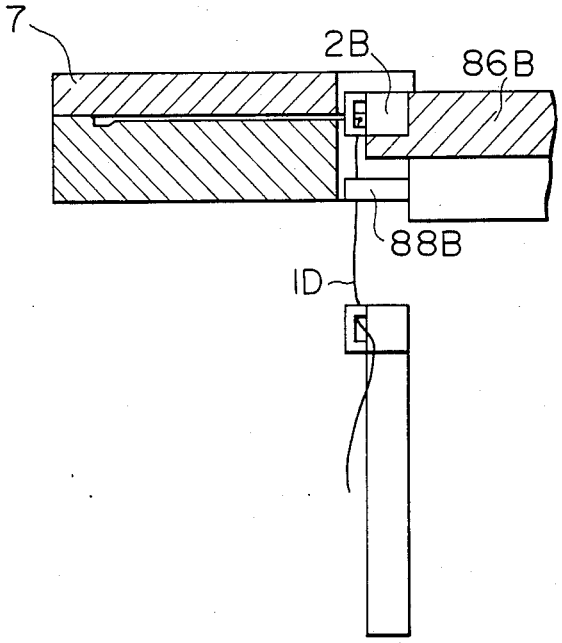
Figure 11:
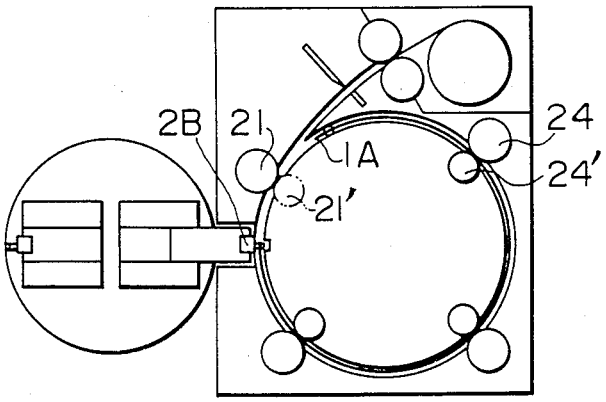

As the slider 86B is moved forwardly to a position shown in FIG. 10 from its position shown in FIG. 9, the core 2B held by the core holding unit 6B is transported to the coil winding section 7 and the wire trailing end portion 1D is gripped by the gripper 88B. FIG. 11 shows in a plan view the core 2B located in the core holding position as the slider 86B has moved forwardly. The wire trailing end portion 1D is pulled downwardly from the wire outlet side of the core 2B, and the wire leading end portion 1A is disposed in a portion of the annular wire guide 11 between the two pairs of rollers 21, 21' and 24, 24'.

The steps of feeding the wire, withdrawing and fixing in place the wire trailing end portion and feeding and discharging the cores have been described. Now let us turn to the step of winding a coil on the core 2B.

The rollers 22' and 21' moved from their positions shown in FIG. 11, so that the roller 22' is now brought out of engagement with the roller 22 while the roller 21' is brought into engagement with the roller 21 (as indicated by a line B in FIG. 16).

Thus, an intermediate portion 1B of the wire 1 is now fed by the rollers 23 and 23', so that it deviates from the annular wire guide 11 and enters the slit 16. Rotation of the rollers 23 and 23' imparts tension to the intermediate portion 1B of the wire 1. The roller 22' is moved into contact with the roller 22 (as shown in FIG. 12 and as indicated by a line D in FIG. 16).

At this time, the roller 24' is engaged with the roller 24 so that the leading end portion 1A of the wire 1 is fed by the rollers 24 and 24' and guided by the annular wire guide 11 until it reaches the rollers 21 and 21'. The roller 24' is then brought out of engagement with the roller 24 (as shown in FIG. 12 and indicated by a line C in FIG. 16). The leading end portion 1A of the wire 1 is further fed by the rollers 21 and 21' and guided by the annular wire guide 11 until it reaches the wire inlet side of the core window 3. At this time, the intermediate portion 1B of the wire 1 is fed by the rollers 21 and 21', so that it deviates from the annular wire guide 11 and enters the slit 16, as shown in FIG. 12.

The rollers 21', 22', 23' and 24' shown in phantom lines in the figures are indicated to be in a position in which they are out of engagement with the respective associated rollers and away from the flat surface portion 14 shown in FIG. 5.

Figure 12:
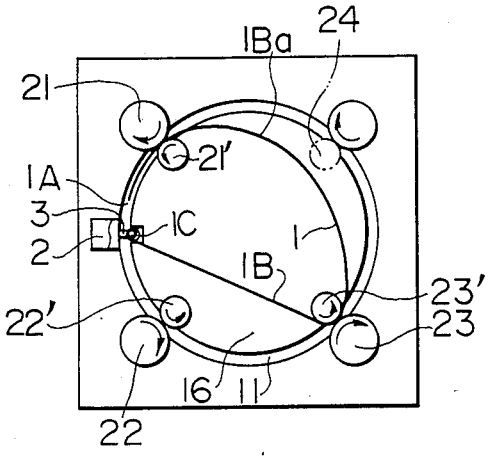
FIGS. 12–15 are views in explanation of the wire winding steps.
Figure 13:
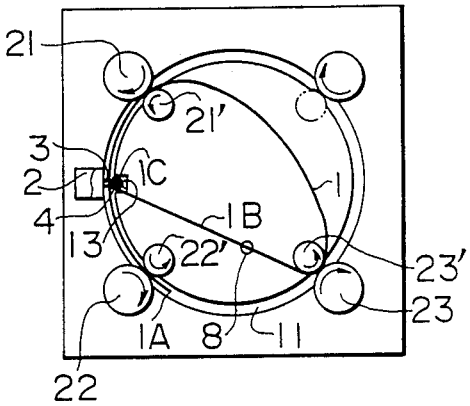

Referring to FIG. 13, the leading end portion 1A of the wire 1 is then fed from its position shown in FIG. 12 by the rollers 21 and 21' past the cutout 13 and through the core window 3. The leading end portion 1A does not interfere with the intermediate portion 1B because the latter is being pulled by the rollers 23 and 23'.

After passing through the core window 3, the leading end portion 1A of the wire 1 is further fed by the rollers 21 and 21' and guided by the annular wire guide 11 until it reaches the rollers 22 and 22'.

Figure 14:
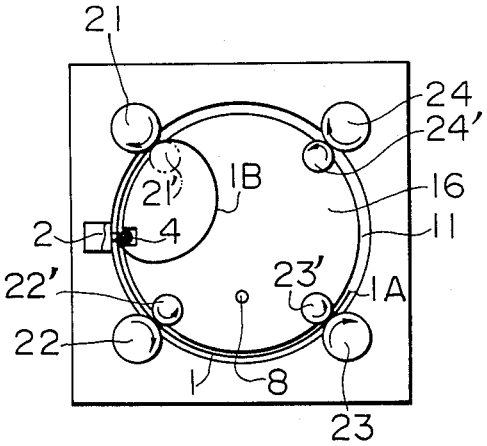

The sensor 8 detects the presence of the intermediate portion 1B of the wire 1 and, after a lapse of a predetermined period of time causes the roller 23' to be disengaged from the roller 23 and lowered away from the flat surface portion 14. The roller 24' is brought into engagement with the roller 24 (as shown in FIG. 14 and as indicated by a line E in FIG. 16). The intermediate portion 1B of the wire 1 is fed by the rollers 21 and 21', so that a loop formed by the intermediate portion 1B, which encircles the coil-winding portion 4 of the core 2 and the roller 21' has its size reduced and gradually becomes a smaller loop, as shown in FIG. 14. At this time, the roller 21' is released from engagement with the roller 21 and moved away from the flat surface portion 14 while the roller 23' is brought into engagement with the roller 23 as indicated by a line F in FIG. 16. Meanwhile, the leading end portion 1A of the wire 1 is fed by the rollers 22 and 22' and guided by the annular wire guide 11 until it reaches the rollers 23 and 23' as shown in FIG. 14.

Figure 15:
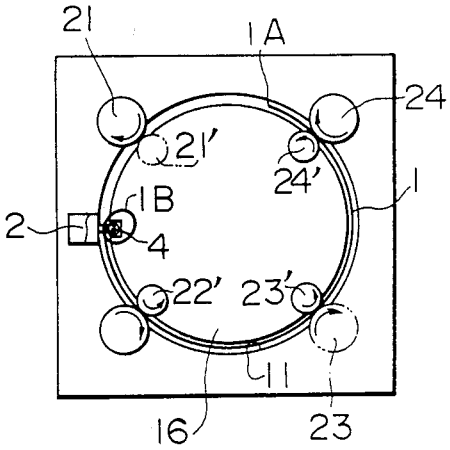
Figure 16:
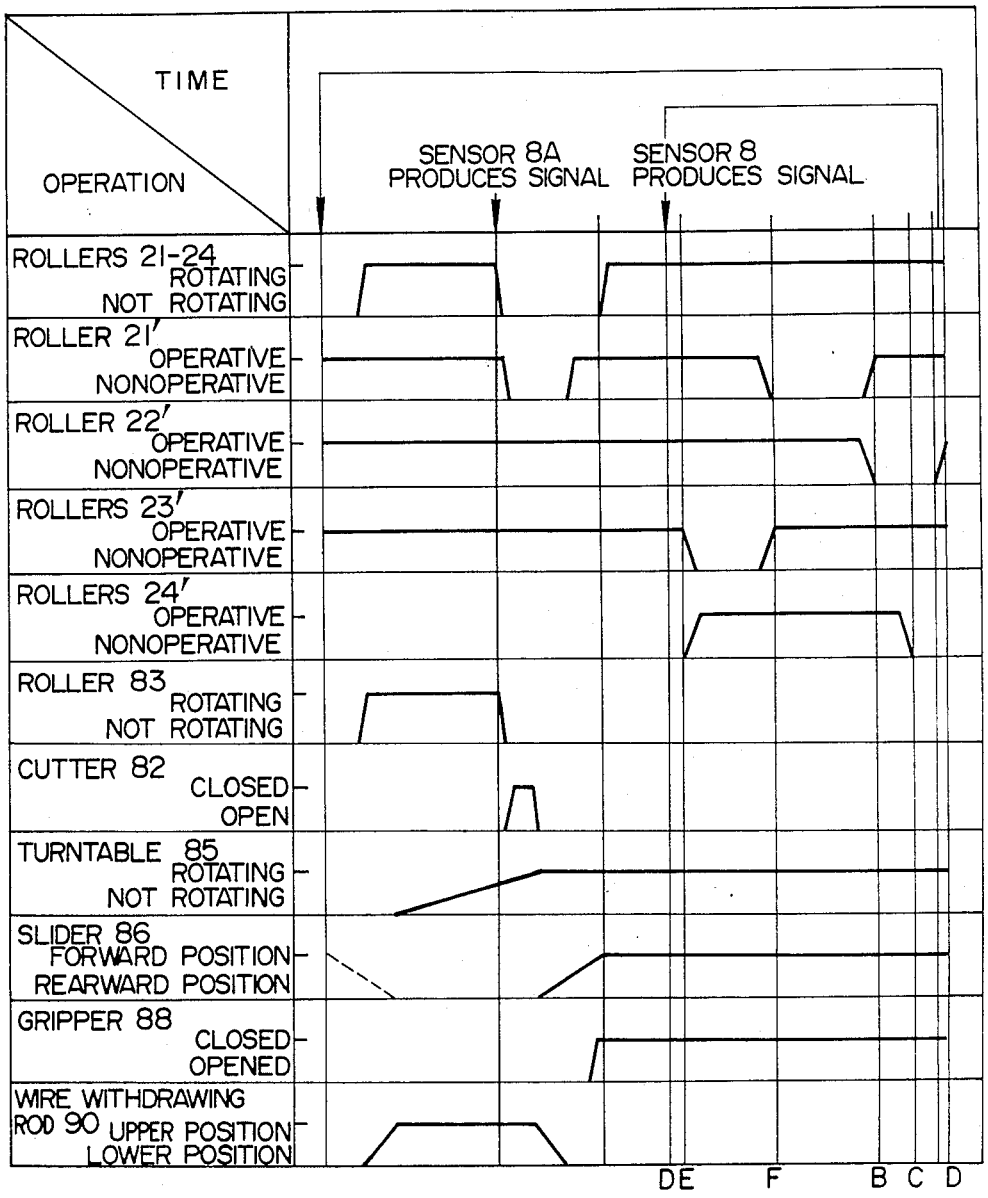
FIG. 16 is a timing chart showing the relationship between the constituent elements of the first embodiment.

The leading end portion 1A of the wire 1 is then fed from its position shown in FIG. 14 by the rollers 23 and 23' and guided by the annular wire guide 11 until it reaches the rollers 24 and 24' as shown in FIG. 15. Meanwhile, the loop formed by the intermediate portion 1B of the wire 1 has its size further reduced and biased toward the coil-winding portion 4 of the core 2.

The roller 22' is moved from the position shown in FIG. 15 and brought out of engagement with the roller 22, while the roller 21' is brought into engagement with the roller 21 again (as shown in FIG. 12 and as indicated by the line B in FIG. 16).

Meanwhile, the leading end portion 1A of the wire 1 is fed by the rollers 24 and 24' and guided in by the annular wire guide 11, until it reaches the rollers 21 and 21' as shown in FIG. 12. At this time, the roller 24' is brought out of engagement with the roller 24 as shown in FIG. 12, and is lowered away from the flat surface portion 14 (as indicated by the line C in FIG. 16). Further rotation of the rollers 21 and 21' feeds the leading end portion 1A of the wire 1, which is guided by the annular wire guide 11, until it reaches the wire inlet side of the core window 3. At this time, the intermediate portion 1B of the wire 1 deviates from the wire guide 11 and enters the slit 16 because it is pulled by the rollers 21 and 21' so that the loop 1B of the further reduced size shown in FIG. 15 is tightened about the coil-winding portion 4 of the core 2 to thereby form an initial winding 1C, as shown in FIG. 12.

The leading end portion 1A of the wire 1 is then fed from the position shown in FIG. 12 by the rollers 21 and 21' into and through the core window 3 without interfering with the initial winding 1C because the intermediate portion 1B of the wire 1 is being pulled by the rollers 23 and 23' away from the coil-winding portion 4 of the core 2.

By performing the operations described hereinabove, one turn of the wire 1 is wound on the core 2. It is possible to produce a coil of the desired number of turns of the wire 1 by repeatedly performing the aforesaid series of operations a predetermined number of times.

From the foregoing description, it will be appreciated that the invention enables application of tension to a portion of the wire already wound on the core and transportation of the intermediate portion of the wire in a direction in which it does not interfere with the movement of the leading end portion of the wire to be achieved automatically and continuously, when the leading end portion of the wire is inserted in the core window. This assures an increase in the speed at which coil winding is effected.

A second embodiment of the invention will now be described by referring to FIGS. 17–29. The apparatus of the second embodiment represents improvements in the apparatus of the first embodiments shown in FIG. 3 and provides better alignment of the wire in the coil and improved dielectric strength.

Figure 17:
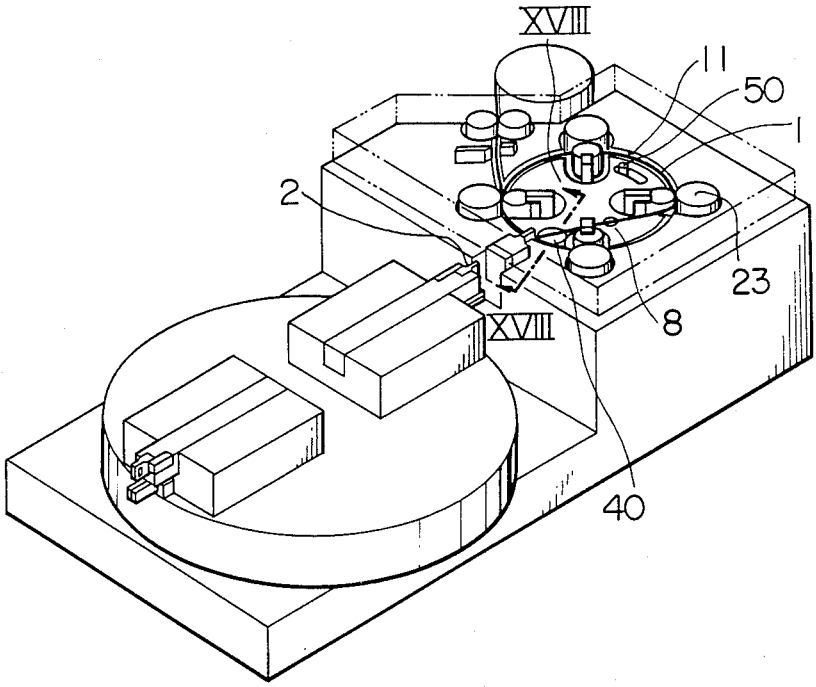
FIG. 17 is a perspective view of a second embodiment of the coil winding apparatus according to the present invention.

In FIG. 17, a pad 40, supported for vertical movement, is located on the wire outlet side of the core 2 inside the annular wire guide 11 of the same construction as shown in FIG. 3 and a pin 50, supported for vertical and pivotal movements, is located inside the annular wire guide 11 in a position substantially diametrically opposed to the core 2. As is the case with the embodiment shown in FIG. 3, the detector 8 for monitoring the presence of the wire 1 is located on an imaginary straight line connecting the core 2 to the roller 23'.

Figure 18:
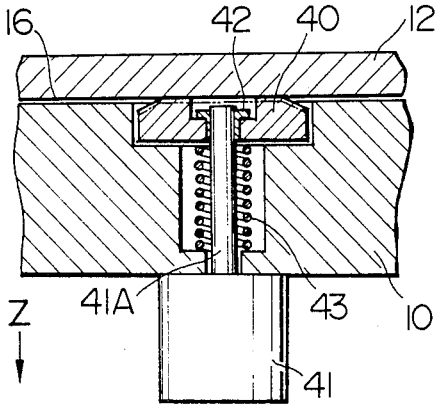
FIG. 18 is a sectional view taken along the line XVIII—XVIII in FIG. 17.

As shown in FIG. 18, the pad 40 is slidably mounted on a vertical shaft 41A of a solenoid 41 supported on the table 10 and forced against the inner surface of the cover 12 by the biasing force of a spring 43 mounted coaxially with the vertical shaft 41A. A sleeve 42 is forcibly fitted onto the upper end portion of the vertical shaft 41A and has a flange which extends in a direction perpendicular to the axis of the vertical shaft 41A. As the solenoid 41 is energized to pull the vertical shaft 41A in the Z direction, the pad 40 is moved from the position in which its upper surface is forced against the inner surface of the cover 12 to a position in which its upper surface is spaced apart from the inner surface of the cover 12, as indicated by a phantom line, a distance corresponding to the vertical dimension of the slit 16.

Figure 19:
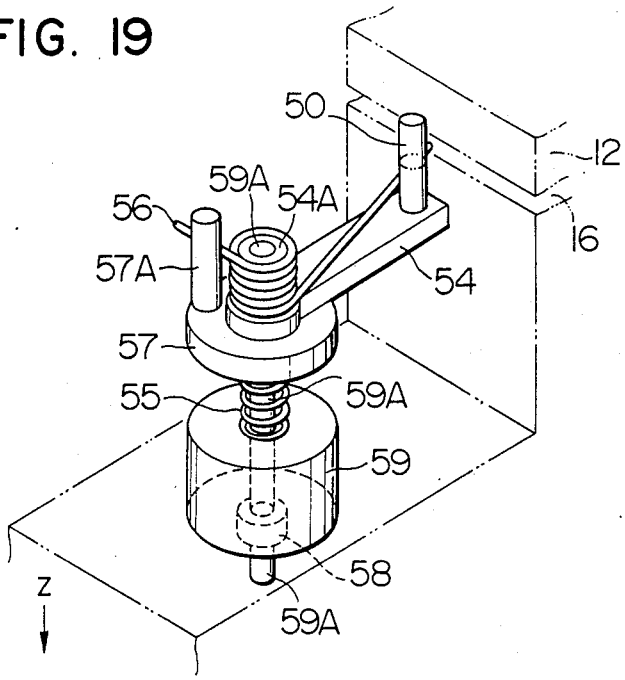
FIG. 19 is a perspective view of a pin drive section of the coil winding apparatus of FIG. 17.

FIG. 19 is a perspective view of a drive of the pin 50 shown in FIG. 17, in which the pin 50 is mounted on an arm 54 rotatably supported by a vertical shaft 59A of a solenoid 59, and one end of a spring 56 mounted concentrically with a projection 54A of the arm 54 is maintained in engagement with the pin 50. An opposite end of the spring 56 is maintained in engagement with a pin 57A mounted on a plate 57 secured to the vertical shaft 59A of the solenoid 59. The pin 50 is biased upwardly by a spring 55 mounted concentrically with the vertical shaft 59A of the solenoid 59 until a collar 58 fitted around the vertical shaft 59A abuts against the solenoid 59, so that the top of the pin 50 is disposed in a position above the upper level of the slit 16. As the solenoid 59 is energized to pull the vertical shaft 59A in the Z direction, the pin 50 is moved downwardly so that its top is disposed in a position below the lower level of the slit 16, as indicated by a phantom line.

A process for winding the wire 1 by using the apparatus shown in FIGS. 17–19 will be described by referring to FIGS. 20–28. FIG. 29 is a timing chart for the operation performed by the apparatus of the second embodiment of the invention.

Figure 20:
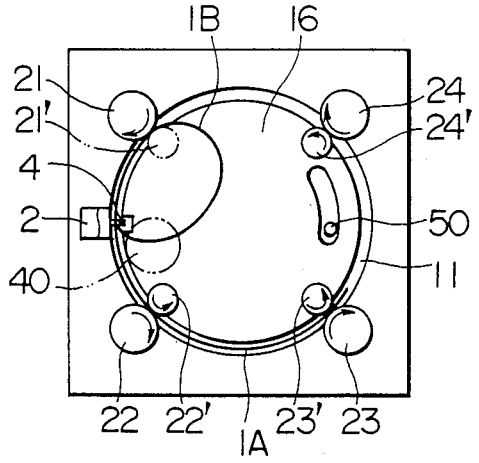
FIGS. 20–28 are views illustrating the steps of winding a coil in the second embodiment shown in FIG. 17.

FIG. 20 shows the coil winding section in which the wire 1 is wound on the core 2. Assume that two turns of the wire 1 have already been wound and the wire 1 is going to be wound on the core 2 to produce a third turn. The leading end portion 1A of the wire 1 is held between the rollers 23 and 23', and the intermediate portion 1B of the wire 1 is disposed in the slit 16 and forms a loop which includes the coil-winding portion 4 of the core 2. The roller 21' is brought out of engagement with the roller 21 and moved away from the flat surface portion 14. The pad 40 is in the lower position and the pin 50 is in the upper position (as indicated by a line G in FIG. 29).

The rollers 21', 22', 23', 24' and the pad 40 and pin 50 are disposed, when they are shown in phantom lines, in positions in which they are moved away or downwardly from the flat surface portion 14 shown in FIG. 5.

Figure 21:
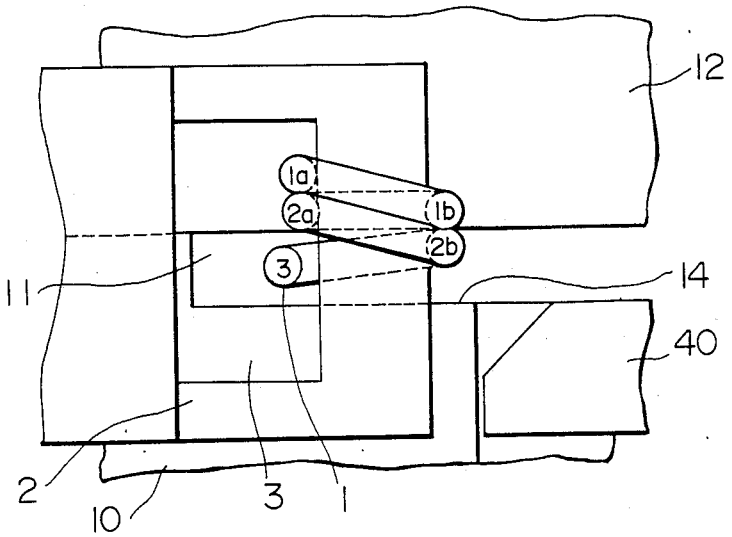

FIG. 21 shows a portion of the core 2 shown in FIG. 20. In FIG. 21, the core 2 is positioned such that a lower end of the cover 12 coincides with a position 2a of the wire 1. A portion of the wire 1, passed through the core window 3 of the core 2 disposed in this position, is disposed in a space defined by the core 2 and annular wire guide 11 (or a position indicated by 3) and does not overlap portions of the wire 1 (in positions 2a and 1a) already wound on the core 2. At this time, the pad 40 is disposed such that its upper end is flush with the flat surface portion 14 of the base 10.

Figure 22:
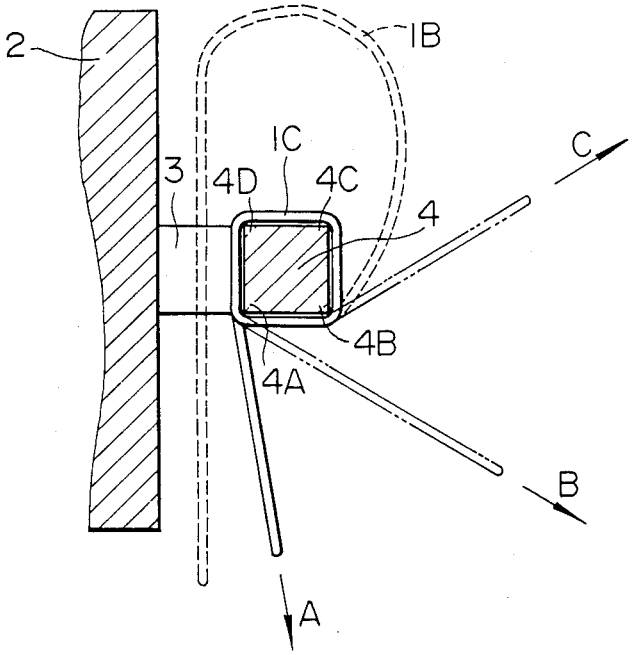

When the coil winding section is in the position shown in FIG. 20, the intermediate portion 1B of the wire 1 is in a phantom line position shown in FIG. 22 and deformed by a corner 4B of the coil-winding portion 4 (corresponding to a position 2b of the wire 1 shown in FIG. 21) to bend, so that there is no risk that the wire 1 might be loosened in this position.

Figure 23:
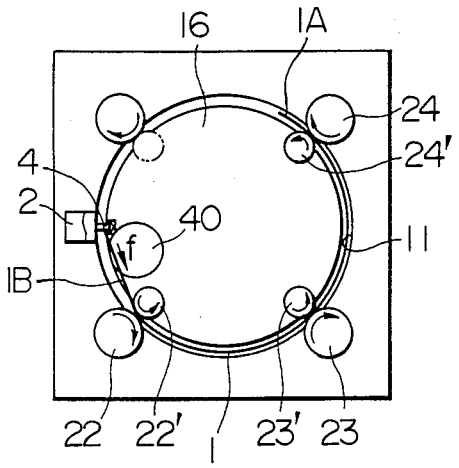
Figure 24:
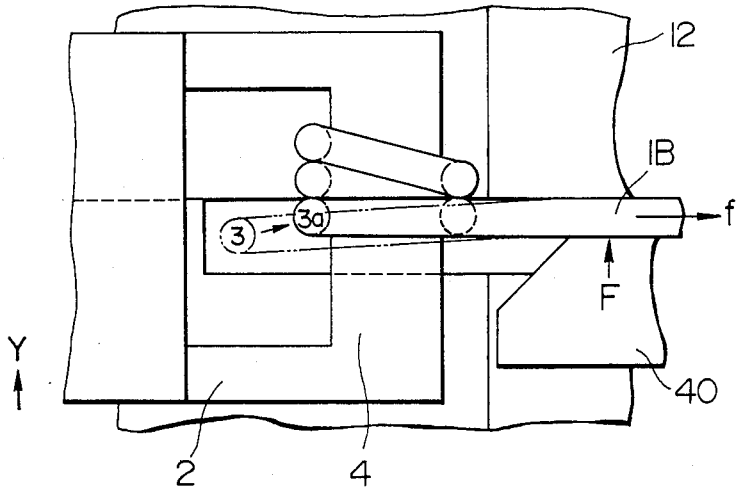

Referring to FIG. 23, the leading end portion 1A of the wire 1 is fed by the rollers 23 and 23' from its position shown in FIG. 20 and guided in its movement by the annular wire guide 11 until it reaches the rollers 24 and 24'. Meanwhile, the intermediate portion 1B of the wire 1 is fed by the rollers 22 and 22' and wound on the coil-winding portion 4 of the core 2. At this time, the pad 40 is moved upwardly and forced against the inner surface of the cover 12. The intermediate portion 1B of the wire fed by the rollers 22 and 22' enters the slit 16 from the annular wire guide 11 to be introduced between the pad 40 and cover 12. Further rotation of the rollers 22 and 22' imparts a tension f to the intermediate portion 1B of the wire 1 to tighten same in a direction extending from the core 2 to the roller 22'. At this time, a reaction F is applied by the pad 40 to the intermediate portion 1B of the wire in the Y direction because the latter enters between the pad 40 and cover 12 as shown in FIG. 24. This causes the tension f imparted to the wire 1 by the rollers 22 and 22' as shown in FIG. 23 to be oriented in a direction extending along the cover 12, so that the wire moves along the cover 12 and is wound on the coil-winding portion 4 of the core 2. Stated differently, the wire disposed in the position 3 is wound on the coil-winding portion 4 in the position 3a, as shown in FIG. 24.

Figure 25:
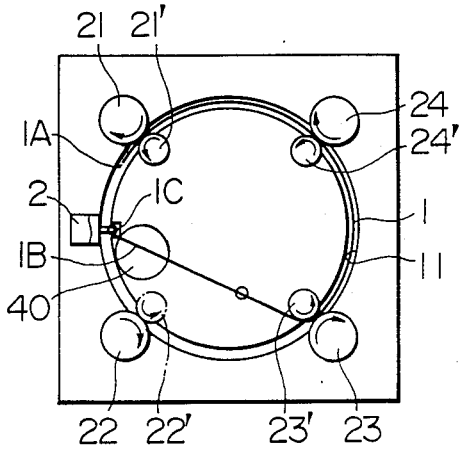

Then, as shown in FIG. 25, the roller 22' is brought out of engagement with the roller 22 in the position shown in FIG. 23 and moved away from the flat surface portion 14. At this time, the intermediate portion 1B of the wire 1 is held between the pad 40 and cover 12, so that the portion 1C of the wire already wound on the core 2 and the intermediate portion 1B of the wire 1 held between the pad 40 and core 2 are prevented from loosening . The roller 21' is brought into contact with the flat surface portion 14 and into engagement with the roller 22 (as indicated by a line H in FIG. 29).

The leading end portion 1A of the wire 1 is fed by the rollers 24 and 24' and guided in its movement by the annular wire guide 11 until it reaches the rollers 21 and 21'. Meanwhile, the intermediate portion 1B of the wire 1 is fed by the rollers 23 and 23', so that it is pulled in a direction extending from the core 2 to the roller 23'. While the intermediate portion 1B is in this position, the roller 22' is brought into engagement with the roller 22 (as indicated by a line I in FIG. 29).

Figure 26:
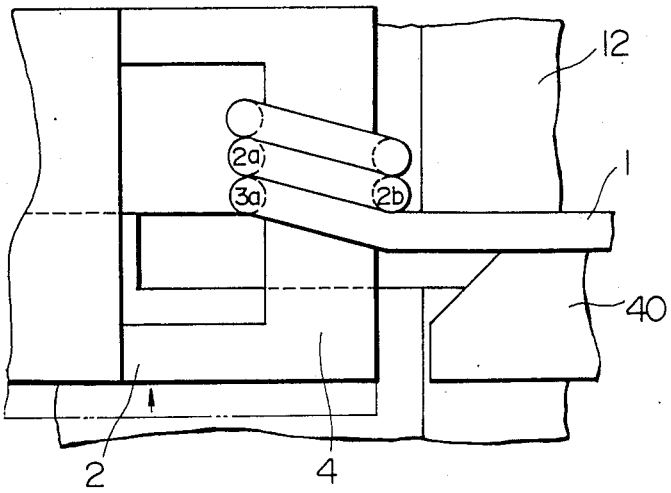

At this time, the core 2 is moved upwardly a distance corresponding to the diameter of the wire 1, as shown in FIG. 26. This causes a portion of the wire 1 extending from the position 3a to the pad 40 to be wound on the coil-winding portion 4 of the core 2 while it is kept in intimate contact with a portion of the wire 1 extending from the position 2a to the position 2b . At this time, the core 2 is positioned such that a lower end of the cover 12 coincides with a lower end of the portion 3a of the wire 1.

Figure 27:
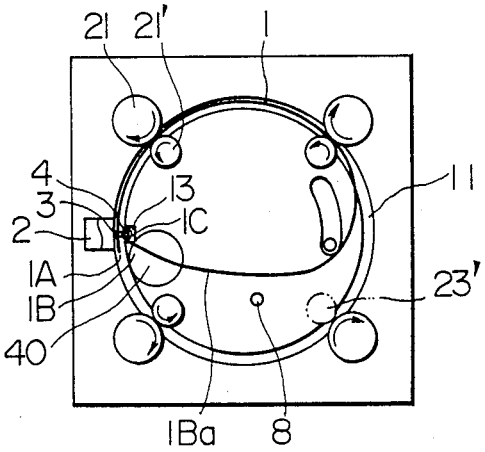

Then, as shown in FIG. 27, the sensor 8 senses the passage of the intermediate portion 1B of the wire 1 from its position shown in FIG. 25 and, after the lapse of a predetermined time period, causes the roller 23' to be disengaged from the roller 23 and moved away from the flat surface portion 14.

At this time, the intermediate portion 1B of the wire 1 is held between the pad 40 and cover 12, so that the portion 1C of the wire 1 already wound on the core 2 and the portion 1B of the wire 1 interposed between the pad 40 and cover 12 are prevented from becoming loose.

The leading end portion 1A of the wire 1 is fed by the rollers 21 and 21' and guided in its movement by the annular wire guide 11 until it reaches the wire inlet side of the core window 3 (as indicated by a line J in FIG. 29). Further rotation of the rollers 21 and 21' moves the leading end portion 1A of the wire 1 into the cutout 13 of the annular wire guide 11. The leading end portion 1A is able to pass through the core window 3 because it does not interfere with the portion 1C of the wire 1 which is already wound tightly on the coil-winding portion 4 of the core 2.

Figure 28:
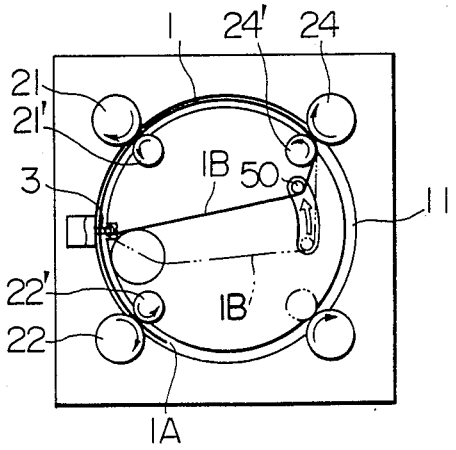
Figure 29:
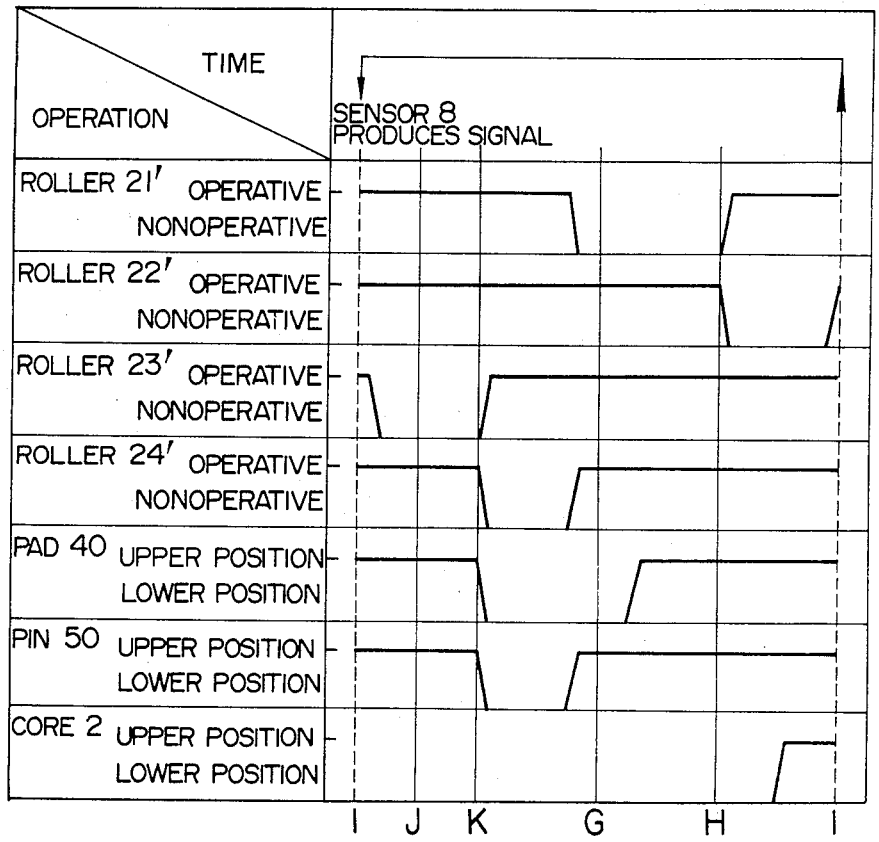
FIG. 29 is a timing chart showing the relationship between the constituent elements of the second embodiment.

Referring to FIG. 28, the leading end portion 1A of the wire 1 that has passed through the core window 3 from its position shown in FIG. 27 is further fed by the rollers 21 and 21' and guided in its movement by the annular wire guide 11 until it reaches the rollers 22 and 22'.

Meanwhile, the intermediate portion 1B of the wire 1 is fed by the rollers 24 and 24' and abuts against the pin 50, so that it is brought to a position shown in a phantom line in FIG. 28. As the rollers 24 and 24' are further rotated, a reaction, produced by the movement of the pin 50 in a direction indicated by a white arrow in FIG. 28 against the biasing force of the spring 56 shown in FIG. 19, tensions the intermedaite portion 1B of the wire 1 in a direction extending from the core 2 to the pin 50.

As shown in FIG. 20, the roller 24' is brought out of engagement with the roller 24 in the position shown in FIG. 28 and moved away from the flat surface portion 14, and the pad 40 and pin 50 are moved downwardly. The roller 23' is brought into engagement with the roller 23 (as indicated by a line K in FIG. 29).

The leading end portion 1A of the wire 1 is fed by the rollers 22 and 22' and guided in its movement by the annular wire guide 11 until it reaches the rollers 23 and 23'. Meanwhile the intermediate portion 1B of the wire 1 is fed by the rollers 21 and 21' and a loop of the wire 1 including the coil-winding portion 4 of the core 2 and the roller 21' has its size gradually reduced into a smaller loop of the wire 1. At this time, the roller 21' is brought out of engagement with the roller 21 and moved away from the flat surface portion 14, and the pin 50 is moved upwardly.

By performing the series of operations described hereinabove, one turn of the wire 1 is wound on the core 2. It is possible to produce a coil of a desired number of turns of the wire 1 by repeatedly performing the aforesaid operations a predetermined number of times.

FIG. 22 shows the manner in which the wire 1 is wound on the coil-winding portion 4 of the core 2.

The wire 1 pulled in an A direction by the rollers 22 and 22' as shown in solid lines in FIG. 22 is pulled in a B direction in FIG. 22 by the rollers 23 and 23' as shown in FIG. 25. Thus the wire 1 is subjected to plastic deformation and deformed to bend by a corner 4A of the coil-winding portion 4 of the core 2, as shown in phantom lines in FIG. 22.

The wire 1 is further tensioned, as shown in FIG. 28, by the rollers 24 and 24' and pin 50 in a C direction in FIG. 22. Thus the wire 1 is subjected to plastic deformation and caused to bend at the corner 4B of the coil-winding portion 4 of the core 2, as shown in phantom lines in FIG. 28.

When the leading end portion 1A of the wire 1 is passed through the core window 3, no tension is imparted to the intermediate portion 1B of the wire 1 any longer as shown in FIG. 20 however, the portion 1C of the wire 1 already wound on the core 2 (in solid lines) does not become loose because the wire 1 has been plastically deformed to bend as described hereinabove.

Even if the wire 1 is pulled, as shown in FIG. 23, by the rollers 22 and 22' and tensioned in the A direction in FIG. 22, the coat on the wire 1 suffers little damage because it is only rubbed at corners 4C and 4D of the coil-winding portion 4 of the core 2 as shown in solid lines in FIG. 23. This contribute to an increase in dielectric strength of the coil wound on the core 2.

From the foregoing description, it will be appreciated that the second embodiment of the invention enables winding of the wire of the coil to be achieved in a good order by virtue of the arrangement whereby the range of movement of the wire through the core window is restricted by the annular wire guide and the wire is wound on the core while being tensioned in a predetermined direction to keep it from becoming loose. Also, the second embodiment enables the dielectric strength of the coil to be increased because the direction in which the wire is tensioned is varied to plastically deformed the wire to bend without becoming loose, to thereby reduce damage which the wire might otherwise suffer when it is wound on the core.

In the second embodiment, the pad 40 and tensioning pad 50 are actuated and the core 2 is moved vertically each time the wire 1 is wound thereon. They may, however, be actuated either singly or in combination.

A third embodiment of the invention will now be described by referring to FIGS. 30–33. This embodiment is based on the first embodiment, as is the case with the second embodiment, and intended to ensure that the operation of passing an extremely thin wire through a minuscule core window is performed with increased reliability.

Figure 30:
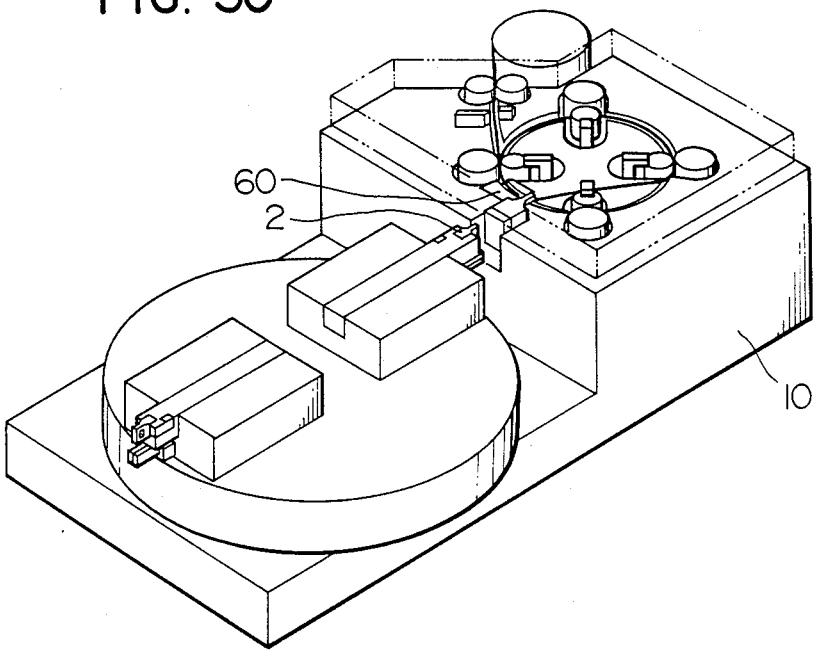
FIG. 30 is a perspective view of a third embodiment of the coil winding apparatus according to the present invention.

FIG. 30 is a perspective view of the third embodiment of the apparatus for winding a wire on a core, the third embodiment additionally comprising a movable wire insertion guide 60 located in a cutout in the base 10 on the side of the core 2

Figure 31:
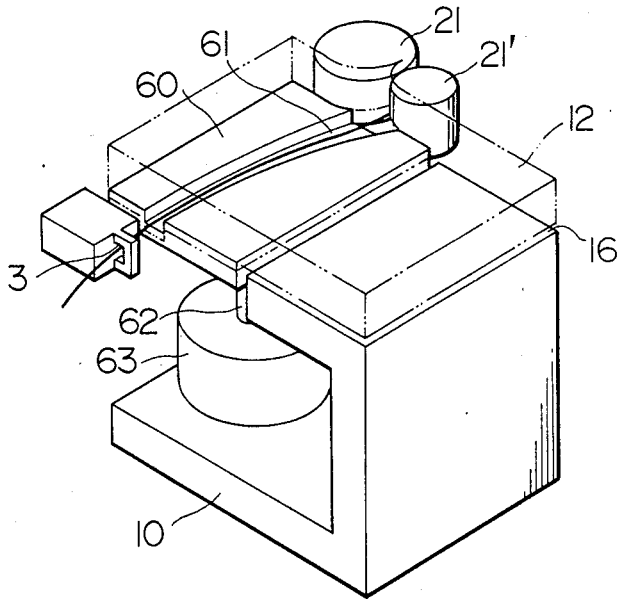
FIG. 31 is a perspective view, on an enlarged scale, of the wire insertion guide of the third embodiment of FIG. 30.

FIG. 31 is a view of the wire insertion guide 60. The wire insertion guide 60 is formed with a groove 61 having two opposite ends, one end being disposed in a wire outlet side of the path of the wire 1 between the rollers 21 and 21' and the other end being aligned with the core window 3. A shaft 62 of a pneumatic cylinder 63 mounted on the base 10 is secured to the wire insertion guide 60. As the pneumatic cylinder 63 is actuated, the wire insertion guide 60 is moved upwardly by the shaft 62 into engagement with the cover 12. Thus the cover 12 encloses the groove 61 to provide a completely enclosed wire guide. When the pneumatic cylinder 63 is deactuated, the wire insertion guide 60 is moved downwardly away from the cover 12 to define therebetween a clearance of substantially the same size as the slit 16.

The operation of winding a coil on the core will now be described by referring to FIGS. 32 and 33.

Figure 32:
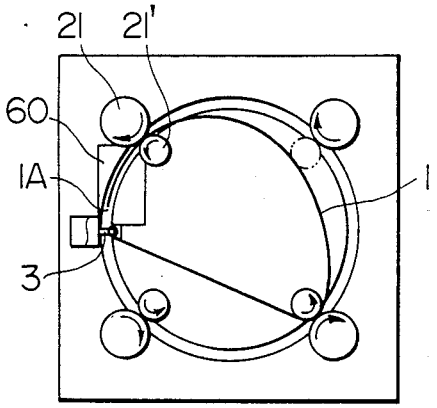
FIGS. 32 and 33 are views illustrating the step of winding a coil in the third embodiment.

FIG. 32 shows a position of the apparatus corresponding to that shown in FIG. 7 after the coil winding has progressed in the same process as in the first embodiment. At this time, the wire insertion guide 60 is located in its upper position in which it is in contact with the cover 12 to provide a fully enclosed wire guide. Rotation of the rollers 21 and 21' feeds the leading end portion 1A of the wire 1 from its position shown in FIG. 32, and the wire insertion guide 60 and cover 12 guide the wire 1 so as to positively insert the leading end portion 1A into the core window 3.

Figure 33:
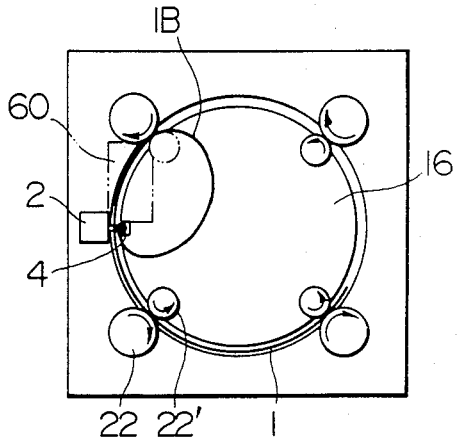

FIG. 33 shows the apparatus in a position corresponding to that shown in FIG. 5 which shows the first embodiment. As shown, the wire insertion guide 60 is disposed in its lower position in which a clearance of substantially the same size as the slit 16 is defined between the wire insertion guide 60 and cover 12. Rotation of the rollers 22 and 22' reduces the size of a loop of wire formed by the intermediate portion 1B of the wire 1 as it moves toward the coil-winding portion 4 of the core 2. The presence of the clearance of substantially the same size as the slit 16 between the wire insertion guide 60 and cover 12 facilitates the reduction in the size of the loop of wire because there is no obstacle to the movement of the intermediate portion 1B of the wire 1.

In the third embodiment of the invention, when the leading end portion 1A of the wire 1 is passed through the core window 3 of the core 2, which is the only obstacle to the movement of the wire 1, the fully enclosed wire guide having no slit 16 and provided by the wire insertion guide 60 cooperating with the cover 12, assures that the leading end portion 1A can be positively passed through the core window 3. This assures improved reliability of the coil winding operation performed by the method according to the invention.

A fourth embodiment of the invention will now be described by referring to FIGS. 34–39. This embodiment is based on the third embodiment and intended to ensure that the operation of passing an extremely thin wire of low rigidity through a minuscule core window is performed with increased reliability.

Figure 34:
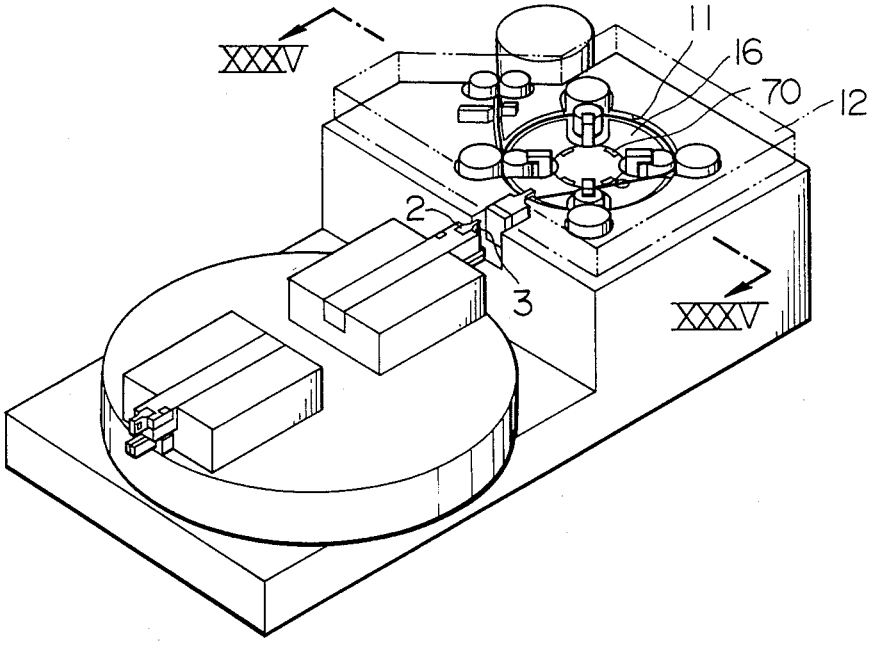
FIG. 34 is a perspective view of a fourth embodiment of the apparatus for winding a coil according to the invention.

FIG. 34 is a perspective view of the fourth embodiment of the apparatus for winding a wire on a core, comprising a plurality of nozzles 70 for feeding air currents from the slit 16 toward the annular wire guide 11, and a nozzle 65 for feeding air currents from the cover 12 above the wire insertion guide 60 toward the core window 3.

Figure 35:
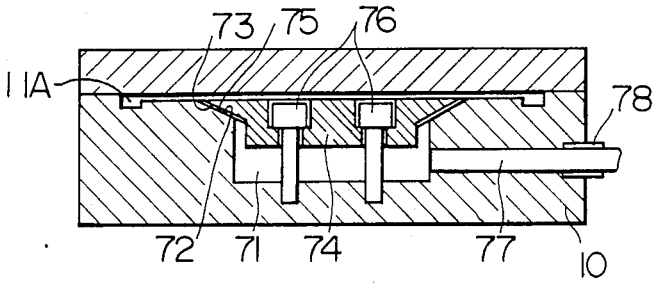
FIG. 35 is a sectional view taken along the line XXXV—XXXV in FIG. 34.

As shown in FIG. 35, formed in the base 10, in a position corresponding to a central portion of an area defined by the annular groove 11A, is a cylindrical recess 71 formed with a sloping upper edge portion 72. A lid 74, for covering the upper open end of the cylindrical recess 71, is formed with a sloping lower edge portion 74 complementary with the sloping upper edge portion 72 of the base 10 and formed with a plurality of radial grooves 75. The lid 74 is threadably secured to the base 10 as indicated at 76. The sloping upper edge portion 72 of the base 10 cooperates with the grooves 75 to define the nozzles 70 which are connected through the cylindrical recess 71 and a duct 77 via joint 78 to a source of compressed air, not shown.

Figure 36:
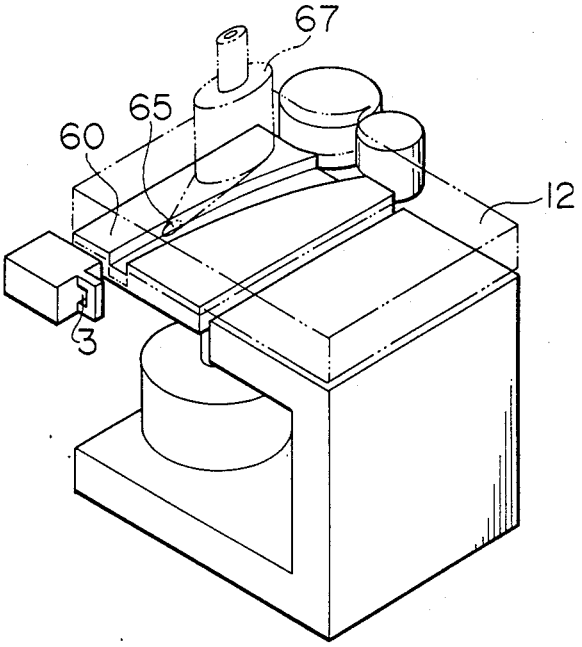
FIG. 36 is a perspective view similar to FIG. 31 but illustrating the wire insertion guide of the fourth embodiment of FIG. 1.

FIG. 36 is a view of the wire insertion guide 60 in which the nozzle 65 is mounted on the cover 12 above the wire insertion guide 60 for feeding air currents toward the core window 3. The nozzle 65 is connected via a joint 67 to a source of compressed air, not shown.

The operation of winding a coil on the core will now be described by referring to FIGS. 37–39.

Figure 37:
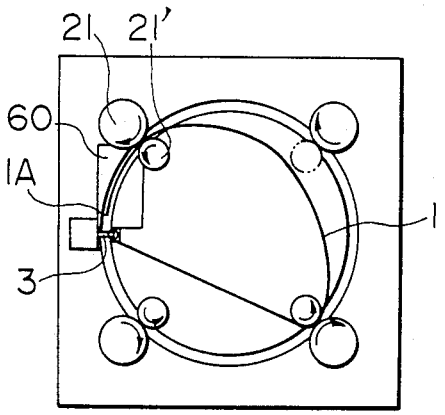
FIGS. 37–39 are views illustrating the steps of the winding a coil in the fourth embodiment of FIG. 34.
Figure 38:
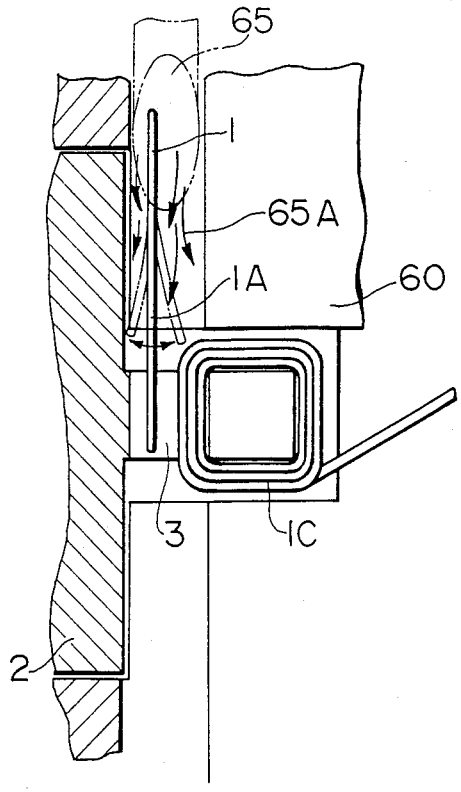

FIG. 37 shows the apparatus in a condition corresponding to that shown in FIG. 32 after coil winding has progressed in the same manner as in the third embodiment. At this time, the wire insertion guide 60 is in its upper position in which it is in contact with the cover 12 to provide a fully enclosed wire guide. Rotation of the rollers 21 and 21′ feeds the leading end portion 1A of the wire 1 from its position shown in FIG. 37, and the leading end portion 1A is positively guided by the wire guide provided by the wire insertion guide 60 and cover 12 and inserted in the core window 3. At this time, an air current 65A supplied through the nozzle 65 in turbulent flow exerts a non-steady force to the leading end portion 1A in the wire insertion guide 60 as shown in FIG. 38, so that the leading end portion 1A moves while vibrating at high speed and with a small amplitude as shown in phantom lines in FIG. 37. This keeps the leading end portion 1A from sticking to the portion 1C of the wire 1 already wound on the core, even if the leading end portion 1A strikes the wound portion 1C of the wire 1, thereby allowing the leading end portion 1A to positively pass through the core window 3.

Figure 39:
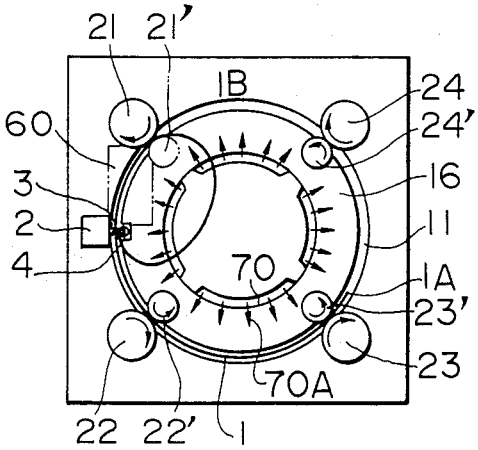

Referring to FIG. 39, the leading end portion 1A of the wire 1 is fed by the rollers 21 and 21′ after passing through the core window 3 and guided in its movement by the annular wire guide 11 until it reaches the rollers 23 and 23′ after passing through the rollers 22 and 22′. Generally, when the wire 1 has a low rigidity, the leading end portion 1A has a tendency to be bent by the impact of its collision with the rollers 21, 21′, 22, 22′, 23, 23′ and 24, 24′ or by the reaction of the annular wire guide 11 resulting in inadvertent entry of the leading end portion 1A into the slit 16. In the fourth embodiment of the invention, the leading end portion 1A is fed while being forced by air currents 70A from the nozzles 70 into the annular wire guide 11. Thus, the leading end portion 1A can be positively fed to the core window 3 without deviating from the annular wire guide 11 and entering the slit 16.

Meanwhile, the intermediate portion 1B of the wire 1 is fed by the rollers 21 and 21′ and moved toward the slit 16 while reducing the size of a loop formed thereby against the air currents 70A supplied through the nozzles 70.

In the fourth embodiment of the invention, the leading end portion 1A of the wire 1 of low rigidity can be positively inserted in the core window 3 because it is caused by the air currents in turbulent flow to vibrate at high speed and with a small amplitude regardless of the size of the core window, 3 the rigidity of the wire 1 and the number of turns of the coil to be produced. Additionally, the use of the air currents enables the leading end portion 1A to be positively guided, even if the wire 1 has a low rigidity.

The structural elements of the apparatus of the first to fourth embodiments of the invention may be used either singly or in combination as desired.

From the foregoing description, it will be appreciated that the invention can achieve a number of significant advantages. More particularly, it is possible to positively wind a coil in a plurality of number of turns because the wire is fed by a plurality of pairs of rollers and guided in its movement by an annular wire guide. Moreover, the coil winding can be performed at high speed because the wire can be continuously passed through the core window and wound on the core in a plurality of number of turns. Additionally, it is possible to obtain an overall compact size of a coil winding apparatus and to reduce its cost because the mechanism is simple in construction. Thus, the invention provides an automatic coil winding apparatus which has a high operational speed, is compact in size and is reliable in performance. Additionally, the coil winding operation can be performed at a high speed because feeding and tensioning of the wire can be continuously effected, and the reliability in performance can be increased because the wire can be positively guided by the annular wire guide and movable wire insertion guide.

What is claimed is:

1. A method of winding a coil on a wire-winding portion of a toroidal coil, the method comprising the steps of:

providing a wire guide means defining an annular wire guide face;

providing feed roller means comprising a plurality of pairs of feed rollers disposed along a circumference of said wire guide face, one of the rollers of each pair being movable between a first position in which said movable roller is in rolling engagement with the other roller and a second position in which said movable roller is out of engagement with the other roller;

providing a core window means in the toroidal core bounded by the wire-winding portion;

providing means for holding the toroidal core in a predetermined position in which the core window means is positioned adjacent to said wire guide face and directed in a circumferential direction thereof;

providing means for moving the movable rollers of the respective pairs of rollers between said first and second positions;

providing means for rotating the rollers of the respective pairs of rollers;

holding the toroidal core in said predetermined position by said holding means;

feeding a leading end portion of a length of wire by said feed roller means along said annular wire guide face;

inserting the leading end portion of the wire into and through said core window means;

pulling the leading end portion of the wire by said feed roller means while a trailing end portion of said length of wire is fixed core whereby an intermediate portion of said wire forms a loop which encircles said wire-winding portion of the toroidal core and the movable roller of at least one of the pairs of rollers, which roller is in said first position; and moving said movable roller of said at least one pair of rollers to said second position to allow the size of said loop to be reduced to said wire-winding portion of said toroidal core.

2. A method of winding a coil on a toroidal core as claimed in claim 1, further comprising the steps of:

providing a vertically movable pad means on an outlet side of the core window means;

providing a pivotal and vertically movable pin at a position substantially diametrically opposite the pad means; and correctly positioning convolutions of the wire wound on the toroidal core by said pad means and said pin.

3. A method of winding a coil on a toroidal core as claimed in claim 1, further comprising the steps of:

providing a wire insertion portion for said annular wire guide face;

providing a cover means; and moving said wire insertion portion in a vertical direction to contact said cover means to provide a sealed wire guide when the leading end portion of the wire is passed through the core window means.

4. A method of winding a coil on a toroidal core as claimed in claim 1, the method further comprising the steps of:

feeding air currents toward the annular guide face while the wire is being wound on the toroidal core.

5. A method of winding a coil on a toroidal core as claimed in claim 1, further comprising the step of:

feeding air currents from a wire inlet side of the core window means toward the core window means when the wire is wound on the toroidal core.

* * * * *